US006744188B2

(12) United States Patent
Nishikawa et al.

(10) Patent No.: US 6,744,188 B2
(45) Date of Patent: Jun. 1, 2004

(54) SPARK PLUG

(75) Inventors: Kenichi Nishikawa, Bisai (JP); Yoshihide Kouge, Kagoshima (JP)

(73) Assignee: NGK Spark Plug Co., Ltd, Aichi (JP)

( * ) Notice: Subject to any disclaimer, the term of this patent is extended or adjusted under 35 U.S.C. 154(b) by 32 days.

(21) Appl. No.: 09/964,859

(22) Filed: Sep. 28, 2001

(65) Prior Publication Data

US 2002/0067110 A1 Jun. 6, 2002

(30) Foreign Application Priority Data

Sep. 29, 2000 (JP) ..... P.2000-299380
Aug. 10, 2001 (JP) ..... P.2001-244462

(51) Int. Cl.[7] ..... H01T 13/20

(52) U.S. Cl. ..... 313/141; 313/130; 501/14; 501/15; 501/16; 501/17; 501/21; 501/22; 501/24

(58) Field of Search ..... 313/130, 141; 501/14, 15, 16, 17, 21, 22, 24

(56) References Cited

U.S. PATENT DOCUMENTS 3,804,666 A * 4/1974 Eppler et al. ..... 428/428
3,898,091 A * 8/1975 Stout ..... 501/20
4,084,976 A 4/1978 Hinton
4,120,733 A 10/1978 Knapp
4,256,497 A 3/1981 Knapp
4,634,634 A 1/1987 Kondo et al.
5,677,250 A 10/1997 Knapp
5,859,491 A * 1/1999 Nishikawa et al. ..... 313/141
5,922,444 A * 7/1999 Tsuzuki et al. ..... 428/220
6,407,487 B1 * 6/2002 Sugimoto ..... 313/141
6,492,289 B1 * 12/2002 Suzuki et al. ..... 501/14

FOREIGN PATENT DOCUMENTS

| | | |
|---|---|---|
| EP | 0 959 542 A1 | 11/1999 |
| JP | 62-15493 | 4/1987 |
| JP | 10-236845 | 9/1998 |
| JP | 11-43351 | 2/1999 |
| JP | 11-106234 | 4/1999 |
| JP | 2000-313681 | 11/2000 |
| JP | 2001-39733 | 2/2001 |

* cited by examiner

*Primary Examiner*—Stephen Husar
*Assistant Examiner*—Sumati Krishnan
(74) *Attorney, Agent, or Firm*—Morgan, Lewis & Bockius LLP

(57) ABSTRACT

A spark plug retains a resistor and has formed on alumina-based insulator a glaze layer, in which the glaze layer contains Pb component in a content of 1 mol % or less in terms of PbO, contains Si component, B component, Zn component, Al component, Ba component and/or Sr component, and contains F component in a content of 1 mol % or less. In addition, the glaze layer contains one kind or more of alkaline metal components, with Li component being necessary, and further contains one kind or more of phosphate ion, sulfate ion, fluoride ion and chloride ion in a content of 0.5 to 10 mol %. The glaze layer has a Vickers hardness Hv of 100 or more, shows excellent strength, especially impact resistance in spite of a reduced content of Pb component.

8 Claims, 2 Drawing Sheets

SPARK PLUG

BACKGROUND OF THE INVENTION

1. Field of the Invention

The present invention relates to a spark plug.

2. Description of the Related Art

A spark plug used for ignition of an internal engines such as automobiles generally comprises a metal shell to which a ground electrode is fixed, an insulator made of alumina ceramics or the like, and a center electrode which is disposed inside the insulator. The insulator projects from the rear opening of the metal shell in the axial direction. A terminal fixture is inserted into the projecting part of the insulator and is connected to the center electrode via a conductive glass seal layer which is formed by a glass sealing procedure or a resistor. A high voltage is applied to the terminal metal fixture to cause a spark over the gap between the ground electrode and the center electrode.

However, under some combined conditions, for example, at an increased spark plug temperature and an increased environmental humidity, it may happen that high voltage application fails to cause a spark over the gap but, instead, a discharge called a flashover occurs between the terminal metal fixture and the metal shell, going around the projecting insulator. Primarily for the purpose of avoiding this flashover phenomenon, most of commonly used spark plugs have a glaze layer on the surface of the insulator. The glaze layer also serves to smoothen the insulator surface thereby preventing contamination and to enhance the chemical or mechanical strength of the insulator.

In the case of the aluminum insulator for the spark plug, a glaze of lead silicate glass has conventionally been used where silicate glass is mixed with a relatively large amount of PbO to lower a softening point. In recent years, however, with a globally increasing concern about environmental conservation, glazes containing Pb have been losing acceptance. In the automobile industry, for instance, where spark plugs find a huge demand, it has been a subject of study to phase out Pb-containing glazes in a future, taking into consideration the adverse influences of waste spark plugs on the environment.

Leadless borosilicate glass- or alkaline borosilicate glass-based glazes have been studied as substitutes for the conventional Pb-containing glazes, but they tend to be insufficient in mechanical strength. For example, in the process of producing spark plugs, they are liable to suffer chipping or delamination of the glaze layer upon conveying the insulators having formed thereon the glaze layer, in a state of being put side by side on a wire gauze, by the impact applied thereto during handling thereof.

SUMMARY OF THE INVENTION

An object of the invention is to provide spark plugs having glaze layers containing a less amount of Pb component, and having an excellent mechanical strength, in particular, impact resistance.

1: Metal shell

2: Insulator

2*d*: Glaze layer

3: Center electrode

4: Ground electrode

DETAILED DESCRIPTION OF THE INVENTION

Figure 1:
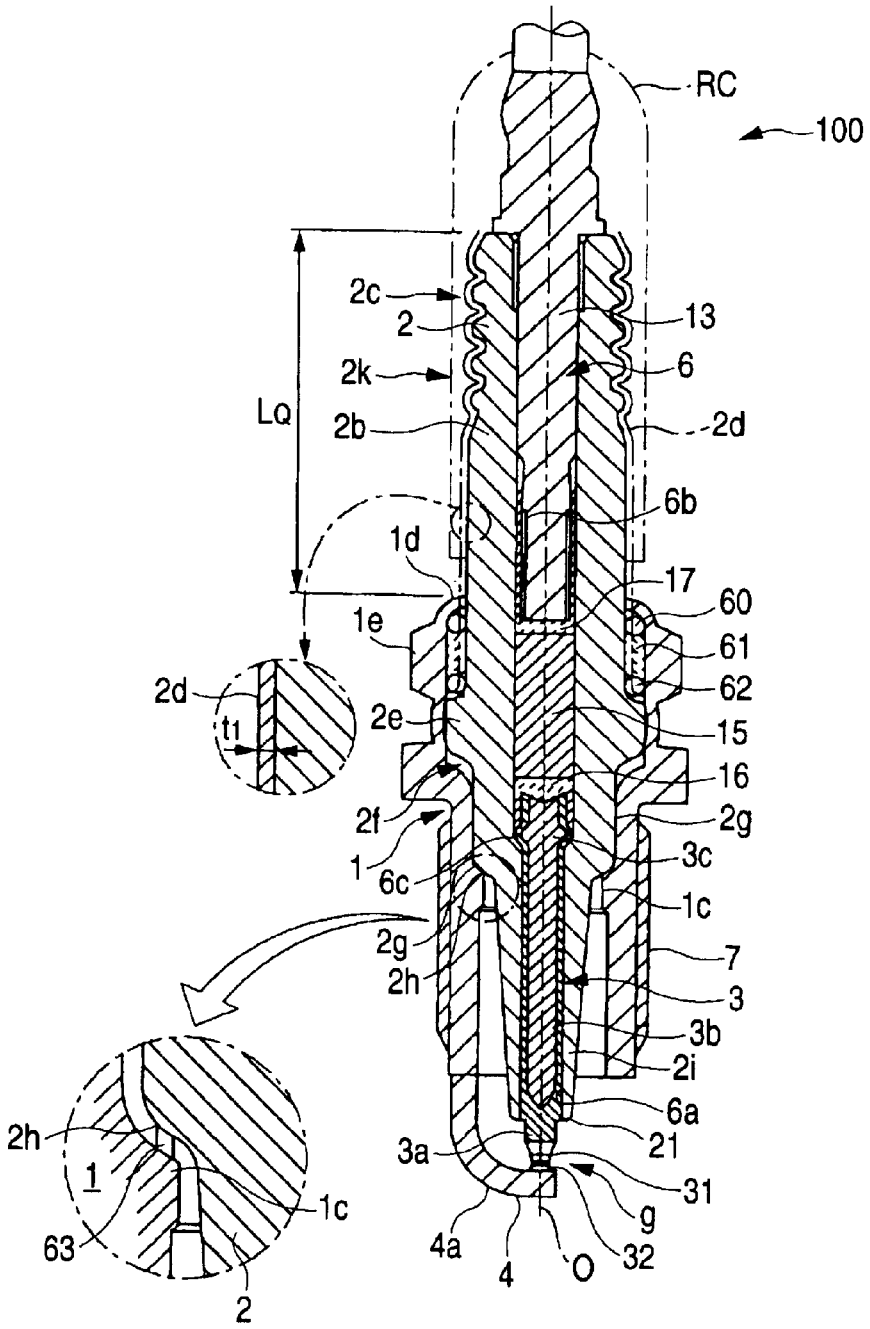
FIG. 1 is a whole front and cross sectional view showing the spark plug according to the invention.

For solving the above problems, the spark plug of the invention has an insulator comprising alumina-based ceramic disposed between a center electrode and a metal shell, wherein at least part of the surface of the insulator is covered with a glaze layer having the content of Pb component of 1 mol % or less in terms of PbO and having a Vickers hardness Hv of 100 or more.

In the spark plug according to the invention, for aiming at the adaptability to the environmental problems, it is a premise that the glaze to be used contains the Pb component in a content of 1.0 mol % or less in terms of PbO (hereinafter the glaze containing the Pb component reduced to this level being called as "leadless glaze"). When the Pb component is present in the glaze in the form of an ion of lower valency (e.g., $Pb^{2+}$), it is oxidized to an ion of higher valency (e.g., $Pb^{3+}$) by a corona discharge. If this happens, the insulating properties of the glaze layer are reduced, which probably spoils an anti-flashover. From this viewpoint, too, the limited Pb content is beneficial. A preferred Pb content is 0.1 mol % or less. It is most preferred for the glaze to contain substantially no Pb (except a trace amount of lead unavoidably incorporated from raw materials of the glaze).

In addition, in the spark plug in accordance with the invention, the glaze layer must have a Vickers hardness Hv of 100 or more. The inventors' investigation has proved that a glaze layer having a Vickers hardness Hv within the above-described range has an improved mechanical strength, especially, impact resistance. Thus, chipping or delamination, or so-called chipping trouble, caused by vibration or impact to be applied to spark plugs upon handling during conveying them on a wire gauze or by Syntron, can be effectively prevented or suppressed, Accordingly, there arises no inferior external appearance or staining during conveying. The Vickers hardness Hv is more preferably 150 or more. Additionally, in the specification of the invention, Vickers hardness test is conducted according to JIS Z2244. The tester to be used for the Vickers hardness test is that adapted for JIS B7725, with the testing load being 2N.

The glaze layer preferably contains Si component in a content of 15 to 60 mol % in terms of $SiO_2$, B component in a content of 22 to 50 mol % in terms of $B_2O_3$, Zn component in a content of 10 to 30 mol % in terms of ZnO, Ba and/or Sr component in a content of 0.5 to 35 mol % in terms of BaO or SrO, F component in a content of 1 mol % or less, Al component in a content of 0.1 to 5 mol % in terms of $Al_2O_3$, and alkaline metal component of 1.1 to 10 mol % in total of one or more of Na, K and Li in terms of $Na_2O$, $K_2O$ and $Li_2O$, respectively, where Li is essential, and the amount of the Li component is 1.1 to 6 mol % in terms of $Li_2O$.

However, according to the studies of the inventors, it was proved that if the amount of Pb component was smaller, a mechanical strength of the glaze layer, in particular impact resistance, was apt to relatively decrease. Therefore, it was found that if Si, B, Zn, Ba and/or Sr, and Al components, further alkaline metal components containing the Li component as a necessary component were contained in the above mentioned ranges, such glaze layers could be provided, enabling to be baked at relatively low temperatures, having excellent insulating property, easily realizing smooth baked surfaces, and heightening the mechanical strength, especially the impact resistance of the insulator formed with the glaze layer. Thereby, chipping or delamination of the glaze layer, or so-called chipping trouble caused by vibration or impact to be applied to the spark plugs upon handling them during conveying on a wire gauze or by Syntron, can be effectively prevented or suppressed. Thus, there difficultly arise inferior external appearance or staining during conveying.

The glaze layer of the invention can be mainly constituted by oxides. In the following, reference will be made to critical meanings of ranges of respective composing components of the glaze layer. Si component is a skeleton forming component of the glaze layer of vitreous substance, and is indispensable for securing the insulating property. With respect to the Si component, being less than 15 mol %, it is often difficult to secure a sufficient insulating performance. Being more than 60 mol %, it is often difficult to bake the glaze. The amount of the Si component should be more preferably 25 to 40 mol %.

B component is also a skeleton forming component of the glaze layer of vitreous substance as well as the Si component, and, if combined with Si component, the B component functions to lower a softening point of the glaze and improve fluidity when baking the glaze for easily obtaining smooth baked surfaces. If content of the B component is less than 22 mol %, the softening point of the glaze goes up, and the baking of the glaze will be difficult. On the other hand, being more than 50 mol %, inferior external appearance such as a glaze crimping is easily caused. Or, water-proof of the glaze slurry might be spoiled. Depending on contents of other components, such apprehensions might occur as a devitrification of the glaze layer, the lowering of the insulating property, or inconsequence of the thermal expansion coefficient in relation with the substrate. It is good to determine the content of B component to range 25 to 35 mol % if possible.

Zn component heightens the fluidity when baking the glaze in substitution for Pb component for easily obtaining the smooth baked surfaces. If compounding Zn component more than a predetermined amount, difference in coefficient of thermal expansion between a substrate of the insulator of alumina based ceramic and the glaze layer is reduced to prevent occurrence of defects in the glaze layer and to restrain residual level of tension residual stress, and heightens strength of the insulator formed with the glaze layer, in particular the impact resistances If the content of Zn component is less than 10 mol %, the thermal expansion coefficient of the glaze layer is too large, defects such as crazing easily occur in the glaze layer. If the content of Zn component is short, the baking of the glaze might be difficult. Being more than 30 mol %, opacity easily occurs in the glaze layer due to the devitrification. It is preferable to adjust the Zn content to the range from 10 to 20 mol %.

Ba and Sr components contribute to heightening of the insulating property of the glaze layer and is effective to increasing of the strength. It the total mount is less than 0.5 mol %, the insulating property of the glaze layer goes down, and the anti-flashover might be spoiled. Being more than 35 mol %, the thermal expansion coefficient of the glaze layer is too high, defects such as crazing easily occur in the glaze layer, Tension stress is easy to remain in the glaze layer when cooling from high temperatures, and strength of the insulator formed with the glaze layer, e.g., the impact resistance is easily spoiled. In addition, the opacity easily occurs in the glaze layer. From the viewpoint of heightening the insulating property and adjusting the thermal expansion coefficient, the total amount of Ba and Sr is desirably determined to be 0.5 to 20 mol %, and in particular if the Si component ranges 25 to 40 mol %, the effect is large. Either or both of the Ba and Sr components may be contained, but the Ba component is advantageously cheaper in a cost of a raw material.

Al component broadens a temperature range available for baking the glaze, stabilizes the fluidity when baking the glaze, and largely heightens the impact resistance of the insulator formed with the glaze. But if being less than 0.1 mol % in terms of oxide, the effect thereof lacks. Further, if being over 5 mol %, the glaze layer to be produced is opaque and mat, and the external appearance of the spark plug is spoiled, and markings formed on the substrate are illegible, resulting in inconveniences as when de-vitrifying. The amount of Al component is desirably 1 to 3 mol %.

Next, the alkaline metal components in the glaze layer is mainly used to lower the softening point of the glaze layer and to heighten the fluidity when baking the glaze. The total amount thereof is determined to be 1.1 to 10 mol %. In case of being less than 1.1 mol %, the softening point of the glaze goes up, baking of the glaze might be probably impossible. In case of being more than 10 mol %, the insulating property of the glaze layer probably goes down, and an anti-flashover might be spoiled. The content of the alkaline metal components is preferably 5 to 3 mol %, with respect to the alkaline metal components, not depending on one kind, but adding in joint two kinds or more selected from Na, K and Li, the insulating property of the glaze layer is more effectively restrained from lowering. As a result, the amount of the alkaline metal components can be increased without decreasing the insulating property, consequently it is possible to concurrently attain the two purposes of securing the fluidity when baking the glaze and the anti-flashover (so-called alkaline joint addition effect). Additionally, in order to more heighten the effect of improving the insulating property obtained by the co-addition of the alkaline metal components, it is possible to compound other alkaline metal components than the third components such as K, Na and subsequent components in ranges of not spoiling conductivity by excessive co-addition of the alkaline metal components. It is particularly preferred to incorporate all of the three of Na, K and Li.

Among the above mentioned alkaline metal components, Li component has particularly high effect for improving the fluidity when baking the glaze, and is not only useful for obtaining the baked smooth surface with lesser defects but also remarkably effective for suppressing increase of the thermal expansion coefficient, leading to remarkably heighten strength of the glaze layer, e.g., impact resistance. If being less than 1.1 mol % in terms of oxide of Li component, the effect is poor, and being more than 6 mol %, the insulating property of the glaze layer is not sufficiently secured. The amount of Li component is desirably 1.5 to 4 mol %.

In particular, the glaze layer preferably contains one, two or more kinds of ions of phosphate ion, sulfate ion, fluoride ion and chloride ion. These ions can be added, for example, by compounding in a form of a salt with the cationic metal ion constituting the glaze layer, and contribute to more enhance strength, for example, impact resistance, of the glaze layer. Further, the sulfate ion is effective for suppressing bubbles remaining in the glaze layer, which contributes to an increase in strength of the glaze layer. That is, in case where bubbles are formed in the glaze layer, they are liable to form a starting point of breakage, leading to spoiling of the strength, for example, impact strength, of the glaze layer.

More preferably, one, two or more kinds of ions (anions) of phosphate ion, sulfate ion, fluoride ion and chloride ion are contained in a content ranging from 0.5 to 10 mol %. In case where content of the above-described ion is less than 0.5 mol %, there results an insufficient effect of improving strength. In case where content of the above-described ion is more than 10 mol %, strength might be decreased. In particular, more remarkable effects can be obtained by compounding the ion in a content ranging from 0.5 to 5 mol %.

Especially, sulfate ion shows the highest effect of improving strength, and it is most preferred to incorporate sulfate ion in a content of 0.5 to 10 mol %. It seems that sulfate ion is liable to present in a higher concentration near the surface of the glaze layer upon baking the glaze and, even when the amount of sulfate is small, it preferentially strengthen the surface portion of the glaze layer, the surface portion being liable to yield the starting points of breakage.

Additionally, it is possible to add the above-described anions by compounding at least part of respective cation component sources for the glaze layer in the form of compounds (or salts) between the cations and the anions. For example, it is possible to add in the form of a phosphate, a sulfate, a fluoride or a chloride of Si, an alkaline metal, an alkaline earth metal or a rare earth metal. In the present invention, contents of the cations are all presented in terms of oxides.

Additionally, in case of using the fluoride ion, a gas containing the F component tends to generate upon baking the glaze, resulting in formation of residual bubbles, and the generated gas might react with refractory constituting wall of a glaze-baking furnace. Hence, the amount of the fluoride ion should be adjusted to a level not causing such troubles. On the other hand, co-addition of F component and the alkaline metal components in some cases reduces the softening point of the glaze to thereby improve fluidity upon baking the glaze, with keeping the content of the alkaline metal components at a low level.

In addition, carbonates or nitrates may also be used as raw material powders for the glaze. These salts function to enhance viscosity of the resulting glaze slurry and serve to prevent or suppress precipitation of the glaze powders suspended in the slurry, thus enhancing stability of the slurry and facilitating coating of the glaze.

Additionally, the glaze layer preferably has a Vickers hardness Hv of 250 or less. In case where Vickers hardness Hv of the glaze layer exceeds 250, the glaze-constituting glass becomes too hard, and the glaze layer is made fragile and might suffer chipping. In addition, a glaze layer having a too high hardness shows a poor bubble removal, with the bubbles being liable to become large in size, Formation of the large-sized bubbles leads to spoiled external appearance of resulting spark plugs and illegible markings formed on the substrate. In addition, thickness of the glaze layer is unavoidably thin at the bubble-formed portions, and hence chipping is more liable to take place at the portions.

Additionally, in the specification of the invention, contents of the metal cation components contained in the glaze layer are calculated assuming that all of them exist in the form of oxides regardless of their existence.

More preferred formulations of the glaze layer will be described below.

It is possible to contain one kind or more of Ti, Zr and Hf 0.5 to 5 mol % in total in terms of $ZrO_2$, $TiO_2$ and $HfO_2$. By containing one kind or more of Ti, Zr or Hf t a water resistance is improved. As to the Zr or Hf component, the effect of improving the water resistance of the glaze slurry is more noticeable than Ti component, By the term "the water resistance is good" is meant that if, for example, powder-like raw materials of the glaze are mixed together with a solvent such as water and is left as a glaze slurry for a long time, such inconvenience is difficult to occur as increasing a viscosity of the glaze slurry owing to elution of the component. As a result, in case of coating the glaze slurry to the insulator, optimization of a coating thickness is easy and unevenness in thickness is reduced. Thus, said optimization and said reduction can be effectively attained. If the total amount of the components is less than 0.5 mol %, the effect is poor, and if being more than 5 mol %, the glaze layer is ready for devitrification.

Further, it is possible to contain one kind or more of Mo, W, Ni, Co, Fe and Mn (hereinafter called as "fluidity improving transition metal component") 0.5 to 5 mol % in total in terms of $MoO_3$, $WO_3$, $Ni_3O_4$, $Co_3O_4$, $Fe_2O_3$, and $MnO_2$, respectively. If adding one kind or more of Mo, W, Ni, Co, Fe and Mn in the above mentioned containing range, it is possible to secure the fluidity when baking the glaze. Therefore, the glaze layer having the excellent insulating property can be obtained by baking at relatively low temperatures, Due to the baked smooth surface, the impact resistance of the insulator with the glaze layer thereon can be heightened further.

If the total amount in terms of oxides is less than 0.5 mol %, it may be difficult to obtain a sufficient effect of improving the fluidity when baking the glaze and of easily obtaining a smooth glaze layer. On the other hand, if exceeding 5 mol %, it may be difficult or impossible to bake the glaze owing to an excessive rise of the softening point of the glaze.

When the content of the fluidity improving transition metal component is excessive, coloring may unintentionally appear in the glaze layer. For example, visual information such as letters, figures or product numbers are printed with color glazes on external surfaces of the insulators for specifying manufacturers and others. However, if the colors of the glaze layer is too thick, it might be difficult to read out the printed visual information through the glaze layer. As another realistic problem, there is a case that tint changing resulted from alternation in the glaze composition is seen to purchasers as "unreasonable alternation in familiar colors in external appearance", so that an inconvenience occurs that products could not always be willingly accepted because of a resistant feeling thereto.

The insulator forming a substrate of the glaze layer comprises alumina-based ceramics which appear white and, in view of preventing or restraining coloration, it is desirable that the coloration in an observed external appearance of the glaze layer formed on the insulator is adjusted to be 0 to 6 in chroma Cs and 7.5 to 10 in lightness Vs, for example, the amount of the above transition metal component is adjusted. If the chroma of the glaze layer exceeds 6, the coloration of the glaze layer is remarkably perceived. On the other hand, if the lightness is less than 7.5, the gray or blackish coloration is easily perceived. In either way, there arises a problem that an impression of "apparent coloration" cannot be prevented. The chroma Cs is preferably 0 to 2, more preferably 0 to 1, and the lightness is preferably 8 to 10, more preferably 9 to 10. In the present specification a measuring method of the lightness Vs and the chroma Cs adopts the method specified in "4.3 A Measuring Method of Reflected Objects" of "4. Spectral Colorimetry" in the "A Measuring Method of Colors" of JIS-Z8722. As a simple substitutive method, the lightness and the chroma can be known just through visual comparisons with standard color chart prepared according to JIS-Z8721

The effect of improving the fluidity when baking the glaze is remarkably exhibited by W nest to Mo and Fe. For example, it is possible that all the necessary transition metal components are made Mo, Fe or W. For more heightening the effect of improving the fluidity when baking the glaze, it is preferable that content of Mo amounts to 50 mol % or more of the fluidity improving transition metal components.

The glaze layer may contain two kinds or more of Ca component of 1 to 10 mol % in terms of CaO and Mg component of 0.1 to 10 mol % in terms of MgO in the total amount of 1 to 12 mol %. These components contribute to improvement of the insulating property of the glaze layer. Especially, Ca component is effective next to Ba component and Zn component, aiming at improvement of the insulating property. If the addition amount is less than their lower limits, the effect may be poor, or exceeding their upper limits or the upper limit of the total amount, the glaze baking may be difficult or impossible due to excessive increase in the softening point.

Auxiliary components of one kind or more of Bi, Sn, Sb, P, Cu, Ce and Cr may be contained in a content of 5 mol % or less in total as Bi in terms of $Bi_2O_3$, Sn in terms of $SnO_2$, Sb in terms of $Sb_2O_5$, P in terms of $P_2O_5$, Cu in terms of CuO, Ce in terms of $CeO_2$, and Cr in terms of $Cr_2O_3$. These components may be positively added in response to purposes or often inevitably included as raw materials of the glaze (or later mentioned clay minerals to be mixed when preparing a glaze slurry) or impurities (or contaminants) from refractory materials in the melting procedure for producing glaze frit. Each of them heightens the fluidity when baking the glaze, restrains bubble formation in the glaze layer, or wraps adhered materials on the baked glaze surface so as to prevent abnormal projections. Bi and Sb are especially effective.

In the composition of the spark plug of the invention, the respective components (excluding phosphate ion, sulfate ion, fluoride ion and chloride ion) in the glaze are contained in the forms of oxides in many cases and, owing to factors of forming amorphous and vitrenous (glass) phases, existing forms as oxides cannot be often identified. In such cases, if the contents of components at values in terms of oxides fall in the above mentioned ranges, it is regarded that they are within the ranges described hereinbefore.

The contents of the respective components in the glaze layer formed on the insulator can be identified by use of known micro-analyzing methods such as EPMA (electronic probe micro-analysis) or XPS (X-ray photoelectron spectroscopy). For example, if using EPMA, either of a wavelength dispersion system and an energy dispersion system is sufficient for measuring characteristic x-ray. Further, there is a method where the glaze layer is peeled from the insulator and is subjected to a chemical analysis or gas analysis for identifying the composition.

Further, the insulator is formed with a projection part in an outer circumferential direction at an axially central position thereof. Taking, as a front side, a side directing toward the front end of the center electrode in the axial direction, a cylindrical face is shaped in the outer circumferential face at the base portion of the insulator main body in the neighborhood of a rear side opposite the projection part. In this case, the outer circumferential face at the base portion is covered with the glaze layer formed with the film thickness ranging from 10 to 50 $\mu$W.

By adjusting the thickness of the glaze layer as mentioned above, the impact resistance of the insulator formed with the glaze layer can be more improved. If the thickness of the glaze layer at said portion of the insulator is less than 10 $\mu$m, the anti-flashover property is insufficient and, in addition, the glaze layer becomes so thin that an absolute strength or a defect covering effect in the insulator surface becomes insufficient, and the impact resistance becomes short. On the other hand, if the thickness of the glaze layer exceeds 50 $\mu$m, it is difficult to secure the insulator with the leadless glaze layer of the above-mentioned composition, similarly resulting in decrease of the anti-flashover or resulting in too much increase after baking the glaze of the residual stress amount which is determined with balance between the thermal expansion ratio and the thickness of the glaze layer so that the impact resistance might lack. The thickness of the glaze layer is desirably 10 to 30 $\mu$m.

In automobile engines, such a practice is broadly adopted that the spark plug is attached to engine electric equipment system by means of rubber caps and, for heightening the anti-flashover, important is the adhesion between the insulator and the inside of the rubber cap. The inventors made intensive studies and found that, in the leadless glaze of borosilicate glass or alkaline borosilicate glass, it is important to adjust thickness of the glaze layer for obtaining a smooth surface of the baked glaze and, though the outer circumference of the base portion of the insulator rain body particularly requires the adhesion to the rubber cap, a sufficient anti-flashover cannot be secured unless appropriate adjustment is made to the film thickness. Therefore, in the insulator having the leadless glaze layer of the above-mentioned composition of the spark plug according to the invention, if the film thickness of the glaze layer covering the outer circumference of the base portion of the insulator is set in the range of the above numerical values, the adhesion between the baked glaze fare and the rubber cap may be heightened, and in turn the anti-flashover may be improved without lowering the insulating property of the glaze layer.

The spark plug having the glaze layer of the invention may be composed by furnishing, in a crazing hole of the insulator, an axially shaped terminal metal fixture as one body with the center electrode or holding a conductive binding layer in relation therewith, said metal fixture being separate from a center electrode. In this case, the whole of the spark plug is kept at around 500° C., and an electric conductivity is made between the terminal metal fixture and a metal shell, enabling to measure the insulating resistant value. For securing an insulating endurance at high temperatures, it is desirable that the insulation resistance value is secured 200 MΩ or higher so as to prevent the flashover.

In measuring the insulation resistance value, a DC constant voltage source (e.g., source voltage 1000 V) is connected to a terminal metal 13 of the spark plug 100, while at the same time, the metal shell 1 is grounded, and a current is passed under a condition where the spark plug 100 disposed in a heating oven is heated at 500 C. For example, imagining that a current value Im is measured by use of a current measuring resistance (resistance value Rm) at the voltage VS, an insulation resistance value Rx to be measured can be obtained according to the formula of (VS/Im)−Rm. The current value Im is measured by output of a differential amplifier for amplifying voltage difference at both ends of the current measuring resistance.

The insulator may be constituted by the alumina-based insulating material containing the Al component in a content of 85 to 98 mol % in terms of $Al_2O_3$. Preferably, the glaze layer has an average thermal expansion coefficient of $50\times10^{-7}$/°C. to $85\times10^{-7}$/°C. at the temperature ranging from 20 to 350° C. Being less than this lower limit, defects such as cracking or glaze skipping easily happen in the glaze layer. On the other hand, being more than the upper limit, defects such as crazing are easy to happen in the glaze layer. The thermal expansion coefficient more preferably ranges from $60\times10^{-7}$/°C. to $80\times10^{-7}$/°C.

The thermal expansion coefficient of the glaze layer is assumed from the values obtained in such ways that samples are cut out from a vitreous glaze bulk body prepared by mixing and melting raw materials such that almost the same composition as the glaze layer is realized, and are measured by a known dilatometer method. The thermal expansion coefficient of the glaze layer on the insulator can be measured by use of, e.g., a laser interferometer or an interatomic force microscope.

The spark plug of the invention can be produced by a production method including;

a step of preparing glaze powders in which the raw material powders of the glaze are mixed at a predetermined ratio, the mixture is heated to 1000 to 1500° C. and melted, the melted material is rapidly cooled, vitrified and ground into powder;

a step of piling the glaze powder on the surface of an insulator to form a glaze powder layer; and a step of heating the insulator, thereby to bake the glaze powder layer on the surface of the insulator.

The powdered raw material of each component (excluding phosphate ion, sulfate ion, fluoride ion and chloride ion) includes not only an oxide thereof (sufficient with complex oxide) but also other inorganic materials such as hydroxide, carbonate, chloride, sulfate, nitrate or phosphate. These inorganic materials should be those capable of being converted to corresponding oxides by heating and melting. Use of the carbonate and the nitrate serves to stabilize the glaze slurry by their effect of preventing precipitation, thus facilitating coating of the glaze. As the raw materials for phosphate ion, sulfate ions fluoride ion and chloride ion, there are used phosphates, sulfates, fluorides and chlorides, respectively. The rapid cooling can be carried out by throwing the melt into water or spraying the melt onto the surface of a cooling roll for obtaining flakes.

The glaze powder is dispersed into water or solvent, so that it can be used as a glaze slurry. For example, if coating the glaze slurry onto the insulator surface to dry it, the piled layer of the glaze powder can be formed as a coated layer of the glaze slurry. By the way, as the method of coating the glaze slurry on the insulator surface, if adopting a method of spraying through a spraying nozzle onto the insulator surface, the piled layer in a uniform thickness of the glaze powder can be easily formed and an adjustment of the coated thickness is easy.

The glaze slurry can contain an adequate amount of a clay mineral or an organic binder for heightening a shape retention of the piled layer of the glaze powder. As the clay mineral, those mainly comprising aluminosilicate hydrate can be used, for example, those mainly comprising one kind or more of allophane, imogolite, hisingerite, smectite, kaolinite, halloysite, montmorillonite, illite, vermiculite, and dolomite (or mixtures thereof) can be used. In relation with the oxide components, in addition to $SiO_2$ and $Al_2O_3$, those mainly containing one kind or more of $Fe_2O_3$, $TiO_2$, CaO, MgO, $Na_2O$ and $K_2O$ can be used.

The spark plug of the invention is constructed of an insulator having a through-hole formed in the axial direction thereof, a terminal metal fixture fitted in one end of the through-hole, and a center electrode fitted in the other end. The terminal metal fixture and the center electrode are electrically connected via an electrically conductive sintered body mainly comprising a mixture of a glass and a conductive material (e.g., a conductive glass seal layer or a resistor). The spark plug having such a structure can be made by a process including the following steps.

An assembly step: a step of assembling a structure comprising the insulator having the through-hole, the terminal metal fixture fitted in one end of the through-hole, the center electrode fitted in the other end, and a filled layer formed between the terminal metal fixture and the center electrode, which filled layer comprises the glass powder and the conductive material powder.

A glaze baking step: a step of heating the assembled structure formed with the piled layer of the glaze powder on the surface of the insulator at temperature ranging from 800 to 950° C. to bake the piled layer of the glaze powder on the surface of the insulator so as to form a glaze layer, and at the same time softening the glass powder in the filled layer.

A pressing step: a step of bringing the center electrode and the terminal metal fixture relatively close within the through-hole, thereby pressing the filled layer between the center electrode and the terminal metal fixture into the electrically conductive sintered body.

In this case, the terminal metal fixture and the center electrode are electrically connected by the electrically conductive sintered body to concurrently seal the gap between the inside of the through-hole and the terminal metal fixture and the center electrode. Therefore, the glaze baking step also serves as a glass sealing step. This process is efficient in that the glass sealing and the glaze baking are performed simultaneously. Since the above-mentioned glaze allows the baking temperature to be as low as 800 to 950° C., the center electrode and the terminal fixture hardly suffer from bad production due to oxidation of the center electrode and the terminal metal fixture, thus the yield of the spark plug being heightened. It is also sufficient that the glaze-baking step is preceded to the glass sealing step.

The softening point of the glaze layer is preferably adjusted to range, e.g., 520 to 700° C. When the softening point is higher than 700° C., the baking temperature above 950° C. will be required to carry out both baking and glass sealing, which may accelerate oxidation of the center electrode and the terminal metal fixture. When the softening point is lower than 520° C., the glaze baking temperature should be set lower than 800° C. In this case, the glass used in the conductive sintered body must have a low softening point in order to secure a satisfactory glass seal. As a result, when an accomplished spark plug is used for a long time in a relatively high temperature environment, the glass in the conductive sintered body is liable to be denaturalized, and where, for example, the conductive sintered body comprises a resistor, the denaturalization of the glass tends to result in deterioration of the performance such as a life under load. Incidentally, the softening point of the glaze is preferably adjusted at temperature range of 520 to 620° C.

Modes for carrying out the invention will be explained with reference to several examples shown by the accompanying drawings. FIG. 1 shows an example of the spark plug of the first structure according to the invention. The spark plug 100 has a cylindrical metal shell 1, an insulator 2 fitted in the inside of the metal shell 1 with its tip 21 projecting from the front end of the metal shell, a center electrode 3 disposed inside the insulator 2 with its ignition part 31 formed at the tip thereof, and a ground electrode 4 with its one end welded to the metal shell 1 and the other end bent inward such that a side of this end may face the tip of the center electrode 3. The ground electrode 4 has an ignition part 32 which faces the ignition part 31 to make a spark gap g between the facing ignition parts.

The metal shell 1 is formed of a cylindrical metal such as a low carbon steel. It has a thread 7 therearound for screwing the spark plug 100 into an engine block (not shown). Symbol 1*e* is a hexagonal nut portion over which a tool such as a spanner or wrench fits to fasten the metal shell 1.

The insulator 2 has a through-hole 6 penetrating in the axial direction. A terminal fixture 13 is fixed in one end of the through-hole 6, and the center electrode 3 is fixed in the other end. A resistor 15 is disposed in the through-hole 6 between the terminal metal fixture 13 and the center electrode 3. The resistor 15 is connected at both ends thereof to the center electrode 3 and the terminal metal fixture 13 via the conductive glass seal layers 16 and 17, respectively. The resistor 15 and the conductive glass seal layers 16, 17 constitute the conductive sintered body, The resistor 15 is formed by heating and pressing a mixed powder of the glass powder and the conductive material powder (and, if desired, ceramic powder other than the glass) in a later mentioned glass sealing step. The resistor 15 may be omitted, and the terminal metal fixture 13 and the center electrode 3 may be integrally constituted by one seal layer of the conductive glass seal.

The insulator 2 has the through-hole 6 in its axial direction for fitting the center electrode 3, and is formed as a whole with an insulating material as follows. That is, the insulating material mainly comprises an alumina-based ceramic sintered body having an Al component in a content of 85 to 98 mol % (preferably 90 to 98 mol %) in terms of $Al_2O_3$.

The specific components other than Al are exemplified as follows.

Si component: 1.50 to 5.00 mol % in terms of $SiO_2$;

Ca component: 1.20 to 4.00 mol % in terms of CaO;

Mg component: 0.05 to 0.17 mol % in terms of MgO;

Ba component: 0.15 to 0.50 mol % in terms of BaO; and

B component: 0.15 to 0.50 mol % in terms of $B_2O_3$.

The insulator 2 has a projection 2*e* projecting outwardly, e.g., flange-like on its periphery at the middle part in the axial direction, a rear portion 2*b* whose outer diameter is smaller than the projecting portion 2*e*, a first front portion 2*g* in front of the projecting portion 2*e*, whose outer diameter is smaller than the projecting portion 2*e*, and a second front portion 2*i* in front of the first front portion 2*g*, whose outer diameter is smaller than the first front portion 2*g*. The rear end part of the rear portion 2*b* has its periphery corrugated to form corrugations 2*c*, The first front portion 2*g* is almost cylindrical, while the second front portion 2*i* is tapered toward the tip 21.

On the other hand, the center electrode 3 has a smaller diameter than that of the resistor 15. The through-hole 6 of the insulator 2 is divided into a first portion 6*a* (front portion) having an almost circular cross section in which the center electrode 3 is fitted and a second portion 6*b* (rear portion; upper side in the drawing) having a circular cross section with a larger diameter than that of the first portion 6*a*. The terminal metal fixture 13 and the resistor 15 are disposed in the second portion 6*b*, and the center electrode 3 is inserted in the first portion 6*a*. The center electrode 3 has an outward projection 3*c* around its periphery near the rear end thereof, with which it is fixed to the electrode. A first portion 6*a* and a second portion 6*b* of the through-hole 6 are connected to each other in the first front portion 2*g* in FIG. 2A, and at the connecting part, a projection receiving face 6*c* is tapered or rounded for receiving the projection 30 for fixing the center electrode 3.

The first front portion 2*g* and the second front portion 2*i* of the insulator 2 connect at a connecting part 2*h*, where a level difference is formed on the outer surface of the insulator 2. The metal shell 1 has a projection 1*c* on its inner wall at the position meeting the connecting part 2*h* so that the connecting part 2*h* fits the projection 1*c* via a gasket ring 63 thereby to prevent slipping in the axial direction. A gasket ring 62 is disposed between the inner wall of the metal shell 1 and the outer side of the insulator 2 at the rear of the flange-like projecting portion 2*e*, and a gasket ring 60 is provided in the rear of the gasket ring 62. The space between the two gaskets 60 and 62 is filled with a filler 61 such as talc. The insulator 2 is inserted into the metal shell 1 toward the front end thereof and, under this conditions the rear opening edge of the metal shell 1 is pressed inward the gasket 60 to form a sealing lip 1*d*, and the metal shell 1 is secured to the insulator 2.

Figure 2A:
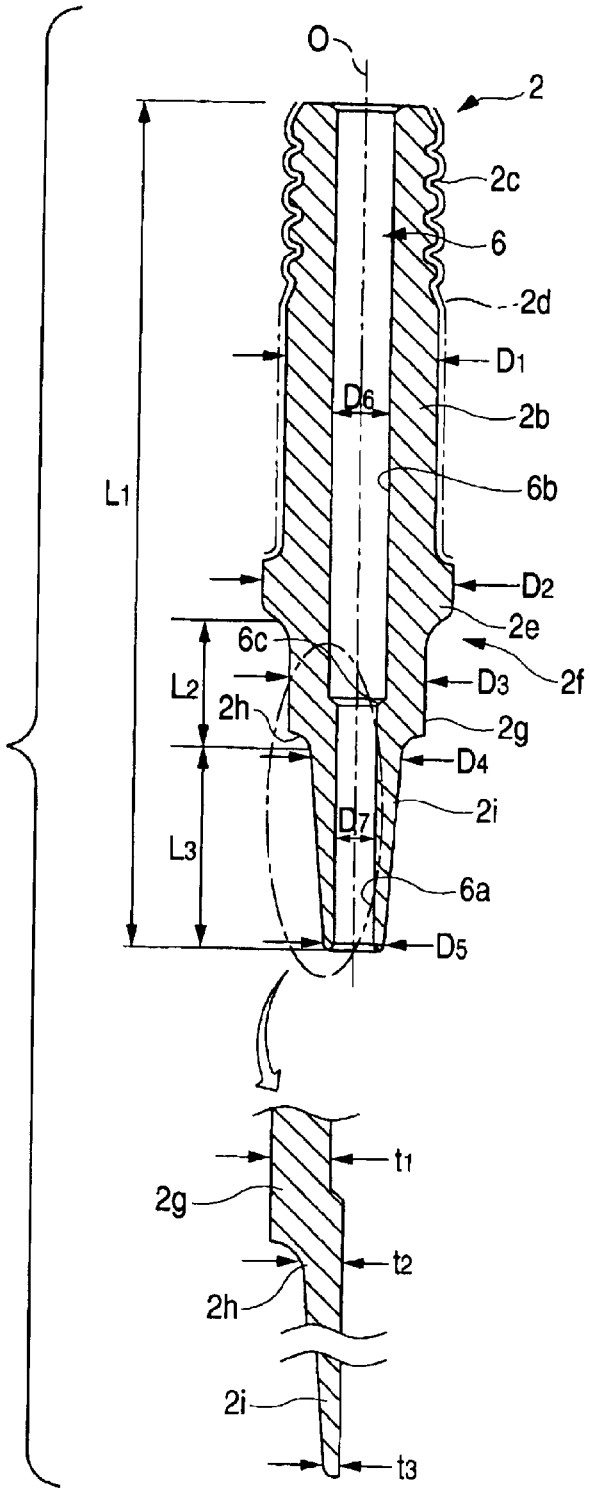
FIGS. 2A and 2B are vertical cross sectional views showing some examples of the insulator The reference numerals used in the drawings are shown below.
Figure 2B:
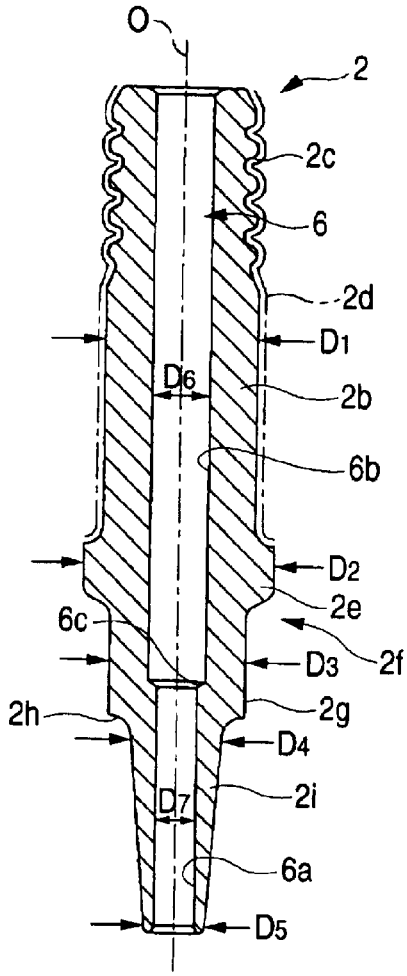

FIGS. 2A and 2B show several examples of the insulator 2.

The ranges of dimensions of these insulators are as follows.

Total length L1: 30 to 75 mm;

Length L2 of the first front portion 2*g*: 0 to 30 mm (exclusive of the connecting part 2*f* to the projecting portion 2*e* and inclusive of the connecting part 2*h* to the second front portion 2*i*);

Length L3 of the second front portion 2*i*: 2 to 27 mm;

Outer diameter D1 of the rear portion 2*b:* 9 to 13 mm;

Outer diameter D2 of the projecting portion 2*e*: 11 to 16 mm;

Outer diameter D3 of the first front portion 2*g*: 5 to 11 mm;

Outer base diameter D4 of the second front portion 2*i*: 3 to 8 mm;

Outer tip diameter D5 of the second front portion 2*i* (where the outer circumference at the tip is rounded or beveled, the outer diameter is measured at the base of the rounded or beveled part in a cross section containing the center axial line O): 2.5 to 7 mm;

Inner diameter D6 of the second portion 6*b* of the through-hole 6; 2 to 5 mm;

Inner diameter D7 of the first portion 6*a* of the through-hole 6; 1 to 3.5 mm;

Thickness t1 of the first front portion 2*g*; 0.5 to 4.5 mm;

Thickness t2 at the base of the second front portion 2*i* (the thickness in the direction perpendicular to the center axial line O: 0.3 to 3.5 mm;

Thickness t3 at the tip of the second front portion 2*i* (the thickness in the direction perpendicular to the center axial line O; where the outer circumference at the tip is rounded or beveled, the thickness is measured at the base of the rounded or beveled part in a cross section containing the center axial line O): 0.2 to 3 mm; and Average thickness tA (=(t2+t3)/2) of the second front portion 2*i;* 0.25 to 3.25 mm.

In FIG. 1, a length LQ of the portion 2*k* of the insulator 2 which projects over the rear end of the metal shell 1, is 23 to 27 mm (e.g., about 25 mm). In a vertical cross section containing the center axial line 0 of the insulator 2 on the outer contour of the projecting portion 2*k* of the insulator 2, the length LP of the portion 2*k* as measured along the profile of the insulator 2 is 26 to 32 mm (e.g., about 29 mm) starting from a position corresponding to the rear end of the metal shell 1, through the surface of the corrugations 2*c*, to the rear end of the insulator 2.

As shown in FIG. 2, the glaze layer 2*d* is formed on the outer surface of the insulator 2*i*, more specifically, on the outer peripheral surface of the rear portion 2*b* inclusive of the corrugated part 2*c*. The glaze layer 2*d* has a thickness of 10 to 150 μm, preferably 10 to 50 μm. As shown in FIG. 1, the glaze layer 2*d* formed on the rear portion 2*b* extends in the front direction farther from the rear end of the metal shell 1 to a predetermined length, while the rear side extends till the rear end edge of the rear portion 2*b*.

The glaze layer 2*d* has any one of the compositions explained in the foregoing columns of the means for solving the problems, works and advantages. As the critical meaning in the composition range of each component has been referred to in detail hereinbefore, no repetition will be made herein. The thickness t1 (average value) of the glaze layer 2*d* on the outer circumference of the base of the rear portion 2*b* (the cylindrical and non-corrugated outer circumference part 2*c* projecting downward from the metal shell) is 10 to 50 μm. the corrugations 2*c* may be omitted. In this case, the average thickness of the glaze layer 2*d* on the area from the rear end of the metal shell 1 up to 50% of the projecting length LQ of the main part 1*b* is taken as t1.

The ground electrode 4 and the core 3*a* of the center electrode 3 are made of a Ni alloy. The core 3*a* of the center electrode 3 is buried inside with a core 3*b* compressing Cu or Cu alloy for accelerating heat dissipation. An ignition part 31 and an opposite ignition part 32 are mainly made of a noble metal alloy based on one kind or more of Ir, Pt and Rh. The core 3*a* of the center electrode 3 is reduced in diameter at a front end and is formed to be flat at the front face, to which a disk made of the alloy composing the ignition part is superposed, and the periphery of the joint is welded by a laser welding, electron beam welding, or resistance welding to form a welded part W, thereby constructing the ignition part 31. The opposite ignition part 32 positions a tip to the ground electrode 4 at the position facing the ignition part 31, and the periphery of the joint is welded to form a similar welded part W along an outer edge part. The tips may be constituted by a sintered material obtained by molding and sintering a molten material prepared by compounding and melting the alloy components at a predetermined ratio or by molding and sintering an alloy powder or a metal mixture powder mixed at a predetermined ratio. At least one of the ignition part 31 and the opposite ignition part 32 may be omitted.

The spark plug 100 can be produced, for example, as follows. In preparing the insulator 2, an alumina powder is mixed with raw material powders of a Si component, Ca component, Mg component, Ba component, and B component in such a mixing ratio as to give the aforementioned composition in terms of oxides after sintering, and the mixed powder is mixed with a prescribed amount of a binder (e.g., PVA) and water to prepare a slurry. Additionally, the raw material powders may be compounded as oxide powders, such as $SiO_2$ powder as the Si component, $CaCO_3$ powder as the Ca component, MgO powder as the Mg component, $BaCO_3$ or $BaSO_4$ powder as the Ba component, and $H_3BO_3$ as the B component. $H_3BO_3$ may be added in the form of a solution.

A slurry is spray-dried into granules for forming a base, and the base-forming granules are rubber-pressed into a pressed body, a prototype of the insulator. The formed body is processed on an outer side by grinding to the contour of the insulator 2 shown in FIG. 1, and then baked at 1400 to 1600° C. to obtain the insulator 2.

The glaze slurry is prepared as follows.

Raw material powders as sources of Si, B, Zn, Ba and alkaline components (Na, K, Li), and phosphate ion, sulfate ion, fluoride ion and chloride ion (for example, $SiO_2$ powder for the Si component, $H_3BO$ powder for the B component, ZnO powder for the Zn component, BaCO3 powder for the Ba component, Na2CO3 powder for the Na component, $K_2CO_3$ powder for the K component, $Li_2CO_3$ powder for the Li component, $K_3PO_4$ powder for phosphate ion, $BaSO_4$ powder for sulfate ion, CaF powder for fluoride ion and KCl powder for fluoride ion) are mixed for obtaining a predetermined composition. The mixed powder is heated and melted at 1000 to 1500° C., and thrown into the water to rapidly cool for vitrification, followed by grinding to prepare a glaze frits. The glaze frits is mixed with appropriate amounts of clay mineral, such as kaolin or gairome clay, and organic binder, and water is added thereto to prepare the glaze slurry.

The glaze slurry is sprayed through a spray nozzle to coat a requisite surface of the insulator, thereby to form a glaze slurry coated layer as the piled layer of the glaze powder.

The step of fitting the center electrode and the terminal metal fixture 13 in the insulator 2 formed with the glaze slurry coated layer and the step of forming the resistor 15 and the electrically conductive glass seal layers 16, 17 are outlined below. First, the center electrode 3 is inserted into the first portion 5*a* of the through-hole 6 of the insulator 2. Then, a conductive glass powder is filled, The powder is preliminarily pressed by pressing a press bar into the through-hole 6 to form a first conductive glass powder layer. A raw material powder for a resistor composition is filled and preliminarily pressed in the same manner, so that the first conductive glass powder, the resistor composition powder layer and a second conductive glass powder layer are laminated from the center electrode 3 (lower side) into the through-hole 6.

An assembled structure is formed where the terminal fixture 13 is disposed from the upper part into the through-hole 6. The assembled structure is put into a heating oven and heated at a predetermined temperature of 800 to 950° C., and then the terminal metal fixture 13 is pressed into the through-hole 6 from a side opposite to the center electrode 3 so as to press the superposed layers in the axial direction. Thereby, the layers are each pressed and sintered to become a conductive glass seal layer 16, a resistor 15 and a conductive glass seal layer 17 (the above is the glass sealing step).

If the softening point of the glaze powder contained in the glaze slurry coated layer 2*d*' is set to be 520 to 700° C., the layer 2*d*' can be baked at the same time as the heating in the above glass sealing step, into the glaze layer 2*d*. Since the heating temperature of the glass sealing step is selected from the relatively low temperature of 800 to 950° C., oxidation to surfaces of the center electrode 3 and the terminal metal fixture 13 can be made less.

If a burner type gas furnace is used as the heating oven (which also serves as the glaze baking oven) a heating atmosphere contains relatively much steam as a combustion product. If the glaze composition containing the B component in a content of 40 mol % or less is used, the fluidity when baking the glaze can be secured even in such an atmosphere, and it is possible to form the glaze layer of smooth and homogeneous substance and excellent in the insulation property.

After the glass sealing step, the metal shell 1, the ground electrode 4 and others are fitted on the structure to complete spark plug 100 shown in FIG. 1. The spark plug 100 is screwed into an engine block using the thread 7 thereof and used as a spark source to ignite an air/fuel mixture supplied to a combustion chamber, A high-tension cable or an ignition coil is connected to the spark plug 100 by means of a rubber cap RC (comprising, e.g., silicone rubber) as shown by one-dot chain line in FIG. 1. The rubber cap RC has a smaller hole diameter than the outer diameter D1 (FIG. 2) of the rear portion 2*b* by about 0.5 to 1.0 mm. The rear portion 2*b* is pressed into the rubber cap while elastically expanding the hole until it is covered therewith to its base. As a result, the rubber cap RC comes into close contact with the outer surface of the rear portion 2*b* to function as an insulating cover for preventing flashover.

By the way, the spark plug of the invention is not limited to the type shown in FIG. 1, but the tip of the ground electrode may be made face the side of the center electrode to form an ignition gap. Further, a semi-planar discharge type sparkplug is also useful where the front end of the insulator is advanced between the side of the center electrode and the front end of the ground electrode.

EXAMPLES

For confirmation of the effects according to the invention, the following experiments were carried out.

The insulator 2 was made as follows. Alumina powder (alumina content; 95 mol %; Na content (as $Na_2O$): 0.1 mol %; average particle size: 3.0 μm) was mixed at a predetermined mixing ratio with SiO2 (purity: 99.5%; average particle size: 1.5 μm), $CaCo_3$ (purity; 99.9%; average particle size: 2.0 μm), MgO (purity: 99.5%; average particle size; 2 μm), BaCO3 (purity: 99.5%; average particle size: 1.5 μm), $H_3BO_3$ (purity: 99.0%; average particle size: 1.5 μm), and ZnO (purity: 99.5%; average particle size: 2.0 μm). To 100 parts by weight of the resulting mixed powder were added 3 parts by weight of PVA as a hydrophilic binder and 103 parts by weight of water, and the mixture was wet kneaded to prepare a slurry for forming the insulator.

The resulting slurry was spray-dried into spherical granules, which were sieved to obtain fraction of 50 to 100 μm. The granules were formed under a pressure of MPa by a known rubber-pressing method. The outer surface of the formed body was machined with the grinder into a predetermined figure and baked at 1550° C. to obtain the insulator 2. The X-ray fluorescence analysis revealed that the insulator 2 had the following composition.

Al component (as $Al_2O_3$: 94.9 mol %;

Si component (as $SiO_2$): 2.4 mol %;

Ca component (as CaO): 1.9 mol %;

Mg component (as MgO): 0.1 mol %;

Ba component (as BaO): 0.4 mol %; and

B component (as $B_2O_3$): 0.3 mol %.

The insulator 2 shown in FIG. 2A has the following dimensions. L1=ca.60 mm, L2=ca.8 mm, L3=ca.14 mm, D1=ca.10 mm, D2=ca.13 mm, D3=ca.7 mm, D4=5.5 mm, D5=4.5 mm, D6=4 mm, D7=2.6 mm, t1=1.5 mm, T2=1.45 mm, T3=1.25 mm and tA=1.35 mm. In FIG. 1, a length LQ of the portion 2*k* of the insulator 2 which projects over the rear end of the metal shell 1, is 25 mm. In a vertical cross section containing the center axial line O of the insulator 2 on the outer contour of the projecting portion 2*k* of the insulator 2*i*, the length LP of the portion 2*k* as measured along the profile of the insulator 2 is 29 mm, starting from a position corresponding to the rear end of the metal shell 1, through the surface of the corrugations 2*c*, to the rear end of the insulator 2.

Next, the glaze slurry was prepared as follows, $SiO_2$ powder (purity: 99.5%), $Al_2O_3$ powder (purity: 99.5%), $H_3BO_3$ powder (purity: 98.5%), $Na_2CO_3$ powder (purity: 99.5%), $K_2CO_3$ powder (purity: 99%), $Li_2CO_3$ powder (purity: 99%), $BaCO_3$ powder (purity: 99.5%), ZnO powder (purity: 99.5%), $MoO_3$ powder (purity: 99%), CaO powder (purity: 99.5%), $TiO_2$ powder (purity: 99.5%) $ZrO_2$ powder (purity: 99.5%), MgO powder (purity: 99.5%), $Sb_2O_6$ powder (purity: 99%), $WO_3$ powder (purity: 99%), $K_3PO_4$ powder (purity: 99%), $BaSO_4$ powder (purity: 99.5%), CaF powder (purity: 99%) and KCl powder (purity: 99.5%) were mixed at various mixing ratios. The mixture was melted at 100 to 1500° C., and the melt was poured into water and rapidly cooled for vitrification, followed by grinding in an alumina pot mill to powder of 50 μm smaller. Three parts by weight of New Zealand kaolin and 2 parts by weight of PVA as an organic binder were mixed into 100 parts by weight of the glaze powder, and the mixture was kneaded with 100 parts by weight of water to prepare the glaze slurry.

The glaze layer was sprayed onto the insulator 2 through the spray nozzle, and dried to form the coated layer 2*d*' of the glaze slurry having a coated thickness of about 100 μm. Several kinds of the sparkplug 100 shown in FIG. 1 were produced by using the insulator 2. The outer diameter of the thread 7 was 14 mm. The resistor 15 was made of the mixed powder consisting of $B_2O_3$—$SiO_2$—BaO—$Li_2O$ glass powder, $ZrO_2$ powder, carbon black powder, $TiO_2$ powders and metallic Al powder. The electrically conductive glass seal layers 16 and 17 were made of the mixed powder consisting of $B_2O_3$—$SiO_2$—$Na_2O$ glass powder, Cu powder, Fe powder, and Fe—B powder. The heating temperature for the glass sealing, i.e., the glaze baking temperature was set at 900° C.

On the other hand, such glaze samples were produced which were not pulverized but solidified in block. The block-like sample was confirmed by the X-ray diffraction to be in a vitrified (amorphous) state, Chemical composition analysis of the sample was conducted by X-ray fluorescence analysis. The analyzed value per each sample (in terms of oxide except for phosphate ion, sulfate ion, fluoride ion and chloride ion) was shown in Table 1. The analytical results obtained by EPMA on the glaze layer 2*d* formed on the insulator were almost in agreement with the results measured with the block-like samples.

Vickers hardness Hv was measured according to the method specified in JIS-Z2244. As a tester for the Vickers hardness test, a hardness micrometer made by K. K. Akashi Seisakusho (MVK-E) (adapting for JIS-B7725), with the testing load being 2N.

The film thickness of the glaze layer on the outer circumference of the base edge part of the insulator was measured in the cross section by the SEM observation.

The respective test articles were subjected to the impact test. An attaching screw portion 7 of the spark plug 100 was urged into a screw hole of the test article fixing bed and fixed there such that the main body part 2*b* of the insulator 2 projected upward. At a more upper part of the main body part 2*b*, an arm was turnably provided to an axial fulcrum located on the center axial line O of the insulator 2. The arm had a length of 330 mm. The axial fulcrum was positioned such that a position of the top of the arm, when it was brought down to a rear-side main body part 2*b*, was 1 mm as a distance in the vertical direction from the backward face of the insulator (so as to correspond to a position of a mark formed on the surface of the rear-side main body part 2*b*). The top of the arm was brought up such that a turning angle of the arm was as predetermined angle from the center axial line O, and operation of bringing down the top by free dropping toward the backward part of the rear-side main body part 2*b* of the insulator was repeated as stepwise making larger at distance of 2 degree to determine impact endurance angle θ demanded as a limit angle when cracks appeared in the insulator. Samples showing the impact endurance angle θ of 40° or more were evaluated as best (O), those of 30° to 40° as good (Δ), and those of less than 30° as bad (x)

The results obtained are shown in Tables 1A and 1B below.

TABLE 1A

| Experiment Example No. | 1* | 2 | 3 | 4 | 5 |
|---|---|---|---|---|---|
| $SiO_2$ | 20.0 | 30.5 | 35.0 | 30.0 | 30.0 |
| $Al_2O_3$ | 1.0 | 1.0 | 1.0 | 1.0 | 1.0 |
| $B_2O_3$ | 60.0 | 40.0 | 28.0 | 39.5 | 39.5 |
| ZnO | 7.0 | 12.0 | 13.0 | 12.0 | 12.0 |
| BaO | 5.0 | 5.0 | 6.0 | 5.0 | — |
| SrO | — | — | — | — | 5.0 |
| $Na_2O$ | 2.0 | 2.0 | — | 2.0 | 2.0 |
| $K_2O$ | 2.0 | 2.0 | 3.0 | 2.0 | 2.0 |
| $Li_2O$ | 1.0 | 0.5 | 2.0 | 1.5 | 1.5 |
| F ($CaF_2$) | — | — | — | — | — |
| Cl (KCl) | — | — | — | — | — |
| $SO_4^{2-}$ ($BaSO_4$) | — | — | 2.0 | 2.0 | 2.0 |
| $PO_4^{3-}$ ($K_3PO_4$) | — | — | 1.0 | 2.5 | 2.5 |
| $ZrO_2$ | 2.0 | 2.0 | 2.5 | 1.5 | 1.5 |
| $TiO_2$ | — | 1.0 | — | — | — |
| $MoO_3$ | — | — | 2.0 | 1.0 | 1.0 |
| $WO_3$ | — | — | 1.0 | — | — |
| CaO | — | — | 3.0 | — | — |
| MgO | — | 3.0 | — | — | — |
| $Sb_2O_3$ | — | 1.0 | 0.5 | — | — |
| Total | 100 | 100 | 100 | 100 | 100 |
| Salt + Fluoride + Chloride | 0 | 0 | 3.0 | 4.5 | 4.5 |
| Vickers Hardness Hv (glaze layer) | 75 | 120 | 160 | 180 | 185 |
| ** | 10 μm | 30 μm | 30 μm | 40 μm | 35 μm |
| *** | x | Δ | ○ | ○ | ○ |

Note:
(unit of composition: mol %);
*: outside the invention
**: Thickness of the glaze layer
***: Evaluation of impact resistance

TABLE 1B

| Experiment Example No. | 6 | 7 | 8 | 9 | 10* |
|---|---|---|---|---|---|
| $SiO_2$ | 30.0 | 33.0 | 30.5 | 28.0 | 8.0 |
| $Al_2O_3$ | 1.0 | 1.0 | 1.0 | 1.0 | — |
| $B_2O_5$ | 39.5 | 39.5 | 40.0 | 30.5 | 20.0 |
| ZnO | 12.0 | 12.0 | 12.0 | 12.0 | — |
| BaO | 4.0 | 5.0 | 5.0 | 5.0 | 14.0 |
| SrO | 1.0 | — | — | — | — |
| $Na_2O$ | 2.0 | 2.0 | 2.0 | 2.0 | 3.0 |
| $K_2O$ | 2.0 | 2.0 | 2.0 | 2.0 | 4.0 |
| $Li_2O$ | 1.5 | 1.5 | 0.5 | 0.5 | 2.0 |
| F ($CaF_2$) | — | — | 3.0 | 3.0 | — |
| Cl (KCl) | — | 1.0 | 1.0 | — | — |
| $SO_4^{2-}$($BaSO_4$) | 4.5 | — | — | 5.0 | 2.0 |
| $PO_4^{3-}$($K_3PO_4$) | — | 2.5 | — | 4.0 | 35.0 |
| $ZrO_2$ | 1.5 | — | 1.0 | 2.5 | 2.0 |
| $TiO_2$ | — | — | — | 1.5 | 3.0 |
| $MoO_3$ | 1.0 | — | 1.5 | — | 2.0 |
| $WO_3$ | — | — | 0.5 | 3.0 | — |
| CaO | — | — | — | — | — |
| MgO | — | — | — | — | 5.0 |
| $Sb_2O_3$ | — | 0.5 | — | — | — |
| Total | 100 | 100 | 100 | 100 | 100 |
| Salt + Fluoride + Chloride | 4.5 | 3.5 | 4 | 12 | 37 |

TABLE 1B-continued

| Experiment Example No. | 6 | 7 | 8 | 9 | 10* |
|---|---|---|---|---|---|
| Vickers Hardness Hv (glaze layer) | 200 | 140 | 140 | 180 | 60 |
| ** | 30 μm | 80 μm | 40 μm | 30 μm | 30 μm |
| *** | ○ | ○ | Δ | Δ | x |
| Remarks | | slight bubbles | | | slight crimping of glaze |

Note:
(unit of composition: mol %);
*: outside the invention
**: Thickness of the glaze layer
***: Evaluation of impact resistance From the above results, it is seen that the glaze layers of 100 or more in Vickers hardness Hv have a good impact resistance, thus showing that impact resistance of the glaze layer is improved. It is also seen that, by selecting formulation of the glaze so as to contain phosphate ion, sulfate ion, fluoride ion or chloride ion in a content of 0.5 to 10 mol %, Vickers hardness Hv and impact resistance of the samples are improved.

This application is based on Japanese patent applications JP 2000-299380, filed Sep. 29, 2000, and JP 2001-244462, filed Aug. 10, 2001, the entire contents of each of which are hereby incorporated by reference, the same as if set forth at length.

What is claimed is:

1. A spark plug comprising:

a center electrode;

a metal shell;

an insulator comprising alumina ceramic and disposed between the center electrode and the metal shell, wherein at least part of the surface of the insulator is covered with a glaze layer, the glaze layer contains 1 mol % or less of PbO, the glaze layer has a Vickers hardness Hv of 100 or more, and the glaze layer contains at least one of phosphate ion, sulfate ion, fluoride ion and chloride ion in a content of 0.5 to 10 mol % in total.

2. The spark plug as set forth in claim 1, wherein the glaze layer contains:

15 to 60 mol % of $SiO_2$;

22 to 50 mol % of $B_2O_3$;

10 to 30 mol % of ZnO;

0.5 to 35 mol % in total of at least one of BaO and SrO;

1 mol % or less of F;

0.1 to 5 mol % of $Al_2O_3$; and 1.1 to 10 mol % in total of at least one of $Na_2O$, $K_{20}$ and $Li_2O$, wherein Li is essential, and the content of $Li_2O$ is 1.1 to 6 mol %.

3. The spark plug as set forth in claim 1, wherein the glaze layer contains sulfate ion in a content of 0.5 to 10 mol %.

4. The spark plug as set forth in claim 1, wherein the glaze layer further contains 0.5 to 5 mol % in total of at lest one of $ZrO_2$, $TiO_2$ and $HfO_2$.

5. The spark plug as set forth in claim 1, wherein the glaze layer further contains 0.5 to 5 mol % in total of at least one of $MoO_3$, $WO_3$, $Ni_3O_4$, $Co_3O_4$, $Fe_2O_3$, and $MnO_2$.

6. The spark plug as set forth in claim 1, wherein the glaze layer shows an external appearance of 0 to 6 in chroma Cs and 7.5 to 10 in lightness Vs when observed in the state that the glaze is formed on the insulator.

7. The spark plug as set forth in claim 1, wherein the insulator is formed with a projection part in an outer circumferential direction at an axially central position thereof, taking, as a front side, a side directing toward the front end of the center electrode in the axial direction, a cylindrical face is shaped in the outer circumferential face at the base portion of the insulator main body in the neighborhood of a rear side opposite the projection part, and the outer circumferential face at the base portion is covered with the glaze layer formed with the film thickness ranging 10 to 50 $\mu$m.

8. A spark plug comprising:

a center electrode;

a metal shell;

an insulator comprising alumina ceramic and disposed between the center electrode and the metal shell, wherein at least part of the surface of the insulator is covered with a glaze layer, the glaze layer contains 1 mol % or less of PbO, the glaze layer has a Vickers hardness Hv of 100 or more, and the glaze layer is formed by adding at least one of $K_3PO_4$ powder, $BaSO_4$ powder, CaF.

* * * * *